US006603246B2

(12) United States Patent
Hori

(10) Patent No.: US 6,603,246 B2
(45) Date of Patent: Aug. 5, 2003

(54) SPARK PLUG USED FOR COGENERATION PURPOSE AND ADJUSTING METHOD FOR DISCHARGING GAP THEREOF

(75) Inventor: Tsunenobu Hori, Kariya (JP)

(73) Assignee: Denso Corporation (JP)

( * ) Notice: Subject to any disclaimer, the term of this patent is extended or adjusted under 35 U.S.C. 154(b) by 106 days.

(21) Appl. No.: 09/785,415

(22) Filed: Feb. 20, 2001

(65) Prior Publication Data

US 2001/0015602 A1 Aug. 23, 2001

(30) Foreign Application Priority Data

Feb. 18, 2000 (JP) ..... 2000-46797
Dec. 28, 2000 (JP) ..... 2000-401231

(51) Int. Cl.[7] ..... H01T 13/20; F02M 57/06
(52) U.S. Cl. ..... 313/141; 313/142; 313/143
(58) Field of Search ..... 313/141–143, 313/123, 142, 131 A, 125; 445/7; 123/169 R, 169 EL

(56) References Cited

U.S. PATENT DOCUMENTS 3,706,897 A * 12/1972 Shepardson ..... 313/139
4,465,952 A * 8/1984 Sato et al. ..... 313/136
5,463,267 A * 10/1995 Conway ..... 313/125
5,898,257 A * 4/1999 Sequerra et al. ..... 123/169 EL
6,307,307 B1 * 10/2001 Kanao ..... 313/118

FOREIGN PATENT DOCUMENTS

| | | |
|---|---|---|
| EP | 0 834 973 | 9/1997 |
| JP | 59-119692 | 7/1984 |
| JP | 61-63788 | 4/1986 |

* cited by examiner

*Primary Examiner*—Sandra O'Shea
*Assistant Examiner*—Dalei Dong
(74) *Attorney, Agent, or Firm*—Nixon & Vanderhye PC

(57) ABSTRACT

A noble metal tip of a grounding electrode is inclinedly disposed with respect to a noble metal chip of a central electrode by an angle α so that a discharging gap is narrow at a side closer to one end of the grounding electrode and wide at the opposite side closer to the other side of the grounding electrode. When the discharging gap has expanded to a certain extent due to exhaustion of the noble metal tips of the electrodes, the re-gapping adjustment is performed to decline or push the noble metal tip of the grounding electrode toward the noble metal tip of the central electrode so as to decrease the angle α. Thus, the discharging gap can be adjusted to an adequate value.

13 Claims, 10 Drawing Sheets

SPARK PLUG USED FOR COGENERATION PURPOSE AND ADJUSTING METHOD FOR DISCHARGING GAP THEREOF

BACKGROUND OF THE INVENTION

The present invention relates to a spark plug applicable to a cogeneration purpose engine, and further relates to an adjusting method of this spark plug performed routinely to restore a discharge gap to an initial value in response to expansion of the discharging gap caused by spark exhaustion.

This kind of spark plug generally comprises a central electrode, an insulator provided around the central electrode, a metal fitting provided around the insulator, a grounding electrode having one end connected to the metal fitting and the other end located in opposed relationship with the central electrode, and noble metal tips attached on opposed surfaces of the central and grounding electrodes. The noble metal tips chiefly contain Ir (iridium). A discharging gap is thus formed between the noble metal tips attached on the opposed surfaces of the central and grounding electrodes.

The cogeneration purpose spark plugs are used at higher temperatures compared with the automotive vehicle spark plugs. Thus, the noble metal tips of the grounding and central electrodes are subjected to severe exhaustion. The discharging gap is relatively small. And, expansion of the discharging gap due to exhaustion of the noble metal tips gives bad influence to voltage characteristics of the plug.

Accordingly, this kind of spark plug requires an adjustment (generally referred to "re-gapping") for restoring the discharge gap to an initial value which is performed routinely when the discharging gap has expanded to a certain extent due to exhaustion of the noble metal tips. The re-gapping adjustment is generally performed by deforming the distal end (i.e., free end) of the grounding electrode about the proximal end (i.e., stationary end) thereof so that the grounding electrode comes close to the central electrode. The discharging gap, having once expanded due to exhaustion of the noble metal tips, is thus reduced to the initial valve.

In this manner, this kind of spark plug is usually re-gapped once at an appropriate time after starting the spark operation from a brand-new condition. After the re-gapping adjustment, the noble metal tips are continuously worn away until it reaches the limit (i.e., exhaustion limit). The lifetime of the plug is generally represented by a period of time required for the noble metal tips to reach the unusable condition. When the lifetime ends, the worn-out plug needs to be replaced by a new one.

However, according to the inventors of this application, the following problems need to be solved to extend the lifetime of the conventional spark plugs. To obtain a satisfactory discharging area (i.e., to secure sufficient wear property), the conventional spark plugs employ a parallel discharging gap arrangement for the central electrode and the grounding electrode in such a manner that the noble metal tips of both electrodes are parallel to each other.

The noble metal tips are kept in parallel even when or after they are exhausted. However, performing the re-gapping adjustment forces the grounding electrode to decline or deform downward about its stationary end. Thus, after the re-gapping adjustment, the positional relationship between the noble metal tips attached on the grounding and central electrodes is no longer kept in parallel. The discharging gap, i.e., a spatial clearance between the opposed noble metal tips attached on the grounding and central electrodes, becomes narrow at one side closer to the free end of the grounding electrode and is wide at the opposite side closer to the stationary end of the grounding electrode.

The non-uniform discharging gap thus provided through the re-gapping adjustment brings bad influence to the noble metal tips. More specifically, regarding the degree of wear or exhaustion, it is faster at the one side of the noble metal tips closer to the free end of the grounding electrode and slower at the opposite side of the noble metal tips closer to the stationary end of the grounding electrode. In other words, after the re-gapping adjustment, wear or exhaustion of the noble metal tips of the spark plug advances non-uniformly in an inclined manner. In this case, the noble metal tips reach the exhaustion limit first at a local spot where the abrasion has advanced rapidly. Thus, the lifetime of the spark plug ends early even if the remaining portion of the noble metal tips are still usable.

As described above, the conventional spark plugs are disadvantageous in that the expensive noble metal tips are not effectively utilized after the re-gapping adjustment is performed. As a result, it was impossible to assure satisfactory wear properties. The lifetime of the conventional spark plugs was relatively short.

SUMMARY OF THE INVENTION

In view of the foregoing problems of the prior art, an object of the present invention is to provide a cogeneration purpose spark plug which essentially requires the re-gapping adjustment and more particularly to assure improved wear properties for the cogeneration purpose spark plug even after the re-gapping adjustment is performed, thereby extending the lifetime of the spark plug.

To accomplish the above and other related objects, the present invention provides a spark plug used for cogeneration purpose, comprising a central electrode, an insulator provided around the central electrode, a metal fitting provided around the insulator, a grounding electrode having one end connected to the metal fitting and the other end located in opposed relationship with the central electrode, and noble metal tips attached on opposed surfaces of the central electrode and the grounding electrode. A discharging gap is formed between the noble metal tip of the central electrode and the noble metal tip of the grounding electrode. Specifically, the spark plug of the present invention is characterized in that the discharging gap has a first gap G1 at one side closer to one end of the grounding electrode and a second gap G2 at the opposite side closer to the other end of the grounding electrode. The first gap G1 is shorter than the second gap G2. Hereinafter, this arrangement is referred to as an inclined discharging gap arrangement.

According to the present invention, the noble metal tips will be worn away locally and non-uniformly due to adoption of the inclined discharging gap arrangement until the re-gapping adjustment is performed. This will slightly shorten the lifetime of the spark plug in the initial stage where no re-gapping adjustment is required, compared with the conventional spark plug. However, the present invention makes it possible to locate the grounding electrode in parallel with the central electrode when the re-gapping adjustment is performed. Accordingly, after the re-gapping adjustment, the remaining noble metal tips are entirely worn out. In other words, almost all of the remaining noble metal tips can be effectively utilized for the final stage of the spark exhaustion. Thus, the present invention assures improved wear properties for the spark plug after the re-gapping adjustment and accordingly extends the lifetime of the spark plug.

According to the present invention, to employ the above-described inclined discharging gap arrangement, it is preferable that a first straight line S1 connecting both edges of the noble metal tip attached on the grounding electrode inclines by an angle $\alpha$ of 2° to 10° with a second straight line S2 connecting both edges of the noble metal tip attached on the central electrode, where the both edges of the noble metal tip of the grounding electrode and the both edges of the noble metal tip of the central electrode cooperatively define the first gap G1 and the second gap G2.

The angle α within a range of 2° to 10° assures the effect of the present invention. On the other hand, the angle α larger than 10° will promote the local and non-uniform exhaustion of the noble metal tips before the re-gapping adjustment. Accordingly, the lifetime of the spark plug in the initial stage preceding the re-gapping adjustment will be so shortened that it cancels the effect of improved wear properties in the final stage succeeding the re-gapping adjustment.

According to the present invention, it is preferable that each of the noble metal tip of the grounding electrode and the noble metal tip of the central electrode is made of an Ir (iridium) alloy, e.g., 90Ir-10Rh, which has excellent wear properties. The lifetime of the spark plug can be extended.

According to the present invention, it is preferable that a minimum distance ΔG of the discharging gap formed between the noble metal tip attached on the grounding electrode and the noble metal tip attached on the central electrode is within a range from 0.2 mm to 0.5 mm.

The discharging gap shorter than 0.2 mm will not bring satisfactory ignitability which is one of basic performances required for the spark plug. On the other hand, the discharging gap larger than 0.5 mm will not sufficiently assure the effect of the inclined discharging gap arrangement brought by the present invention. The lifetime of the spark plug will not be extended so much.

Furthermore, the present invention provides an adjusting method for a cogeneration purpose spark plug which comprises a metal fitting for mounting a central electrode via an insulator provided around the central electrode, a grounding electrode having one end connected to the metal fitting and the other end located in opposed relationship with the central electrode, and noble metal tips attached on opposed surfaces of the central electrode and the grounding electrode so that a discharging gap is formed between the noble metal tip of the central electrode and the noble metal tip of the grounding electrode, wherein the discharging gap is adjusted when the noble metal tips are exhausted to a certain extent.

More specifically, according to the adjusting method of the present invention, the noble metal tips of respective electrodes are disposed in such a manner that the discharging gap has a first gap G1 at one side closer to the one end of the grounding electrode and a second gap G2 at the opposite side closer to the other end of the grounding electrode, with the first gap G1 being shorter than the second gap G2, so that a first straight line S1 connecting both edges of the noble metal tip attached on the grounding electrode inclines by an angle α with respect to a second straight line S2 connecting both edges of the noble metal tip attached on the central electrode, where the both edges of the noble metal tip of the grounding electrode and the both edges of the noble metal tip of the central electrode cooperatively define the first gap G1 and the second gap G2. The discharging gap is adjusted to an adequate value when the discharging gap is increased due to exhaustion of the noble metal tips of both electrodes, by bringing the noble metal tip attached on the grounding electrode to a position closer to the noble metal tip attached on the central electrode so as to decrease the angle α.

According to the adjusting method of the present invention, from the same reason set forth above, it becomes possible to assure improved wear properties for the spark plug after the re-gapping adjustment and accordingly extend the lifetime of the spark plug.

According to the adjusting method of the present invention, from the same reason set forth above, it is preferable that the angle α is within a range from 2° to 10°.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1:
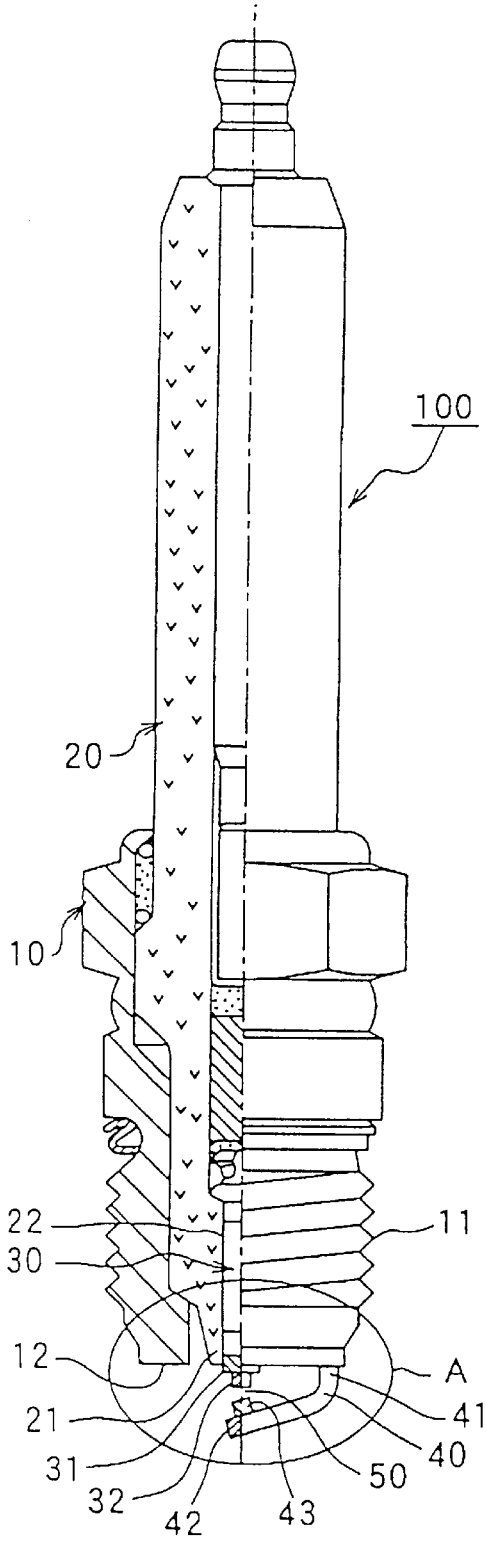
FIG. 1 is a half cross-sectional view showing an overall arrangement of a spark plug in accordance with a preferred embodiment of the present invention.
Figure 2A:
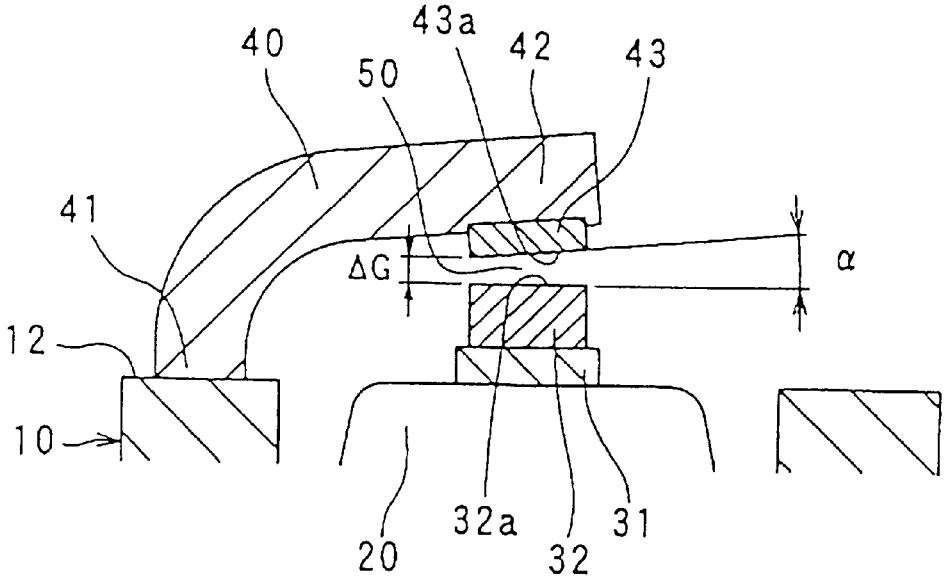
FIG. 2A is a cross-sectional view showing the details of an encircled portion A shown in FIG. 1.
Figure 2B:
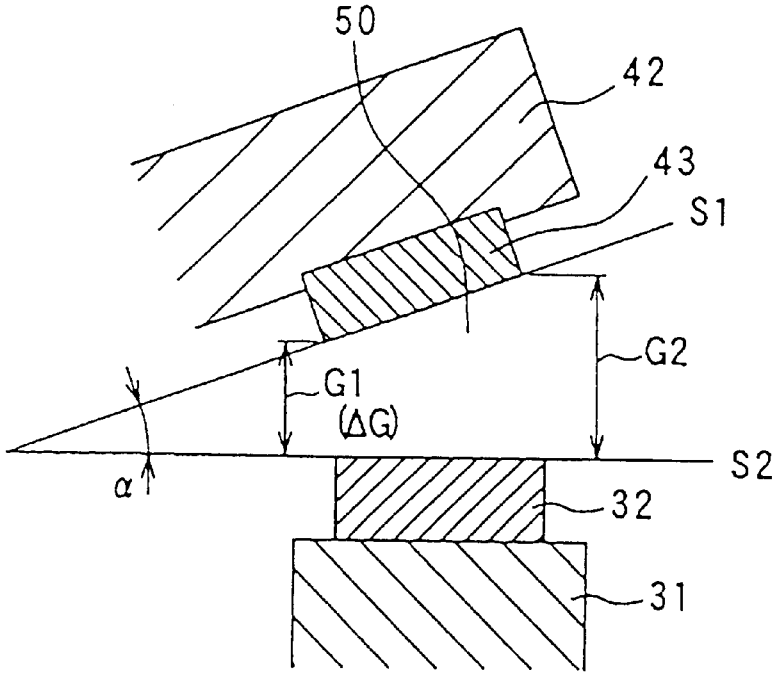
FIG. 2B is an enlarged view showing an essential part of FIG. 2A.

Hereinafter, preferred embodiments of the present invention will be explained with reference to attached drawings. The following embodiments disclose spark plugs applicable to a gas engine of a cogeneration purpose generator. FIG. 1 is a half cross-sectional view showing an overall arrangement of a spark plug 100 in accordance with a preferred embodiment of the present invention. FIG. 2A is a cross-sectional view showing the details of an encircled portion A shown in FIG. 1. FIG. 2B is an enlarged view showing an essential part of FIG. 2A.

The spark plug 100 has a cylindrical metal fitting (i.e., housing) 10. The metal fitting 10 comprises a thread ridge 11 which is fixedly engaged with a corresponding thread hole formed on an engine block (not shown). An insulator 20, made of alumina ceramic $Al_2O_3$ etc., is fixedly supported in the inside space of the metal fitting 10. The insulator 20 has a front end 21 exposed to the outside from an opening of one axial end 12 of the metal fitting 10.

The insulator 20 has an inside hole 22 for securely supporting a columnar central electrode 30 therein. A front end 31 of the central electrode 30 is exposed to the outside from the front end 21 of the insulator 20. Thus, the metal fitting 10 supports the central electrode 30 via the insulator 20.

The central electrode 30 has an inside metallic member, such as Cu (i.e., copper), having excellent thermal conductivity and an outside metallic member, such as Ni (i.e., nickel)-based alloy, having excellent heat resistivity and corrosive resistivity. A noble metal tip (e.g., Ir or Ir allow) 32, for example configured into a disk shape, is attached on the front end 31 by welding or the like. The noble metal tip 32 is hereinafter referred to as a central electrode tip which constitutes part of the central electrode 30.

A columnar grounding electrode 40, made of a Ni-based alloy or the like, is fixed to the axial end 12 of the metal fitting 10 by welding or the like. The grounding electrode 40 has one end (i.e., stationary end) 41 fixed to the axial end 12 of the metal fitting 10, an intermediate portion substantially bent into the L shape, and the other end (i.e., free end) 42 opposing to the front end 31 of the central electrode 30.

A noble metal tip (e.g., Ir or Ir allow) 43, for example configured into a disk shape, is attached on a confronting portion of the grounding electrode 40 by welding or the like. The noble metal tip 43 is hereinafter referred to as a grounding electrode tip which constitutes part of the grounding electrode 40. The grounding electrode tip 43 is thus located in opposed relationship with the central electrode tip 32 so as to form a discharging gap 50 therebetween.

The spark plug 100 is installed in the cogeneration engine so as to locate that the discharging gap 50 in a combustion chamber (not shown) of this engine. The discharging gap 50 causes a spark when a high voltage is applied between the metal fitting 10 and the central electrode 30. The spark of the discharging gap 50 ignites the fuel gas in the combustion chamber.

The spark plug of this embodiment employs a unique arrangement for the discharging gap 50, as shown in FIGS. 2A and 2B. The central electrode tip 32 and the grounding electrode tip 43 are disposed in such a manner that the discharging gap 50 has a first gap G1 at one side closer to the stationary end (i.e., one end) 41 of the grounding electrode 40 and a second gap G2 at the opposite side closer to the free end (i.e., the other end) 42 of the grounding electrode 40, with the first gap G1 being shorter than the second gap G2.

According to the arrangement of this embodiment, the grounding electrode tip 43 is disposed in an inclined fashion with respect to the central electrode tip 32 so that the discharging gap 50 becomes small at one side closer to the stationary end (i.e., one end) 41 of the grounding electrode 40 and wide at the opposite side closer to the free end (i.e., the other end) 42 of the grounding electrode 40. Thus, the opposed surfaces (i.e., discharging surfaces) 32*a* and 43*a* of the central electrode tip 32 and the grounding electrode tip 43 are kept in a non-parallel relationship.

This arrangement is referred to as an inclined discharging gap arrangement for the noble metal tips. The discharging gap 50 of the inclined discharging gap arrangement is defined by the smallest clearance between the opposed electrode tips 43 and 32 which corresponds to a shortest gap $\Delta G$ of the discharging gap 50 existing at the one side closer to the stationary end 41 of the grounding electrode 40.

Furthermore, according to the inclined discharging gap arrangement for the noble metal tips, a first straight line S1 connecting both edges of the grounding tip 43 inclines by an angle $\alpha$ with respect to a second straight line S2 connecting both edges of the central electrode tip 32, where the both edges of the grounding electrode tip 43 and the both edges of the central electrode tip 32 cooperatively define the first gap G1 and the second gap G2 (refer to FIG. 2B)).

According to this embodiment, the inclination angle $\alpha$ represents an intersecting angle between the opposed surfaces 32*a* and 43*a* of the central electrode tip 32 and the grounding electrode tip 43. A preferable value of the angle $\alpha$ is within a range from 2° to 10°. As shown in FIGS. 2A and 2B, the inclination angle $\alpha$ is defined as a positive value when measured in the counterclockwise direction with respect to the opposed surface 32(=0°) of the central electrode tip 32 or a negative value when measured in the clockwise direction.

Although there is no intent to narrowly limit the present invention, practical dimensions of the above-described spark plug 100 are as follows.

The front end 31 of the central electrode 30 is a columnar Ni-based alloy member with a diameter of 2.9 mm. The central electrode tip 32 is a disklike Ir (i.e., iridium) alloy member with a diameter of 2.4 mm and a thickness of 1.5 mm. The grounding electrode 40 is a rectangular rodlike Ni-based alloy member having a width of 3.3 mm and a thickness of 1.6 mm. The grounding electrode tip 43 is a disklike Pt (i.e., platinum) alloy member having a diameter of 2.2 mm and a thickness of 0.55 mm. The discharging gap 50 is 0.28 mm. The inclination angle $\alpha$ is 6°.

The above-described inclined discharging gap arrangement can be formed in the following manner. A worker assembles the central electrode 30 and the insulator 20 with the metal fitting 10. Then, the worker fixes the one end 41 of the grounding electrode 40 to the one axial end 12 of the metal fitting 10 by welding or the like. Next, the worker bends or deforms the grounding electrode 40 with a jig while measuring the discharging gap 50 with a pin gauge so as to bring the other end 42 of the grounding electrode 40 to a predetermined position with respect to the central electrode 30, thereby forming a regulated discharging gap 50 between the grounding electrode tip 43 and the central electrode tip 32.

Figure 3:
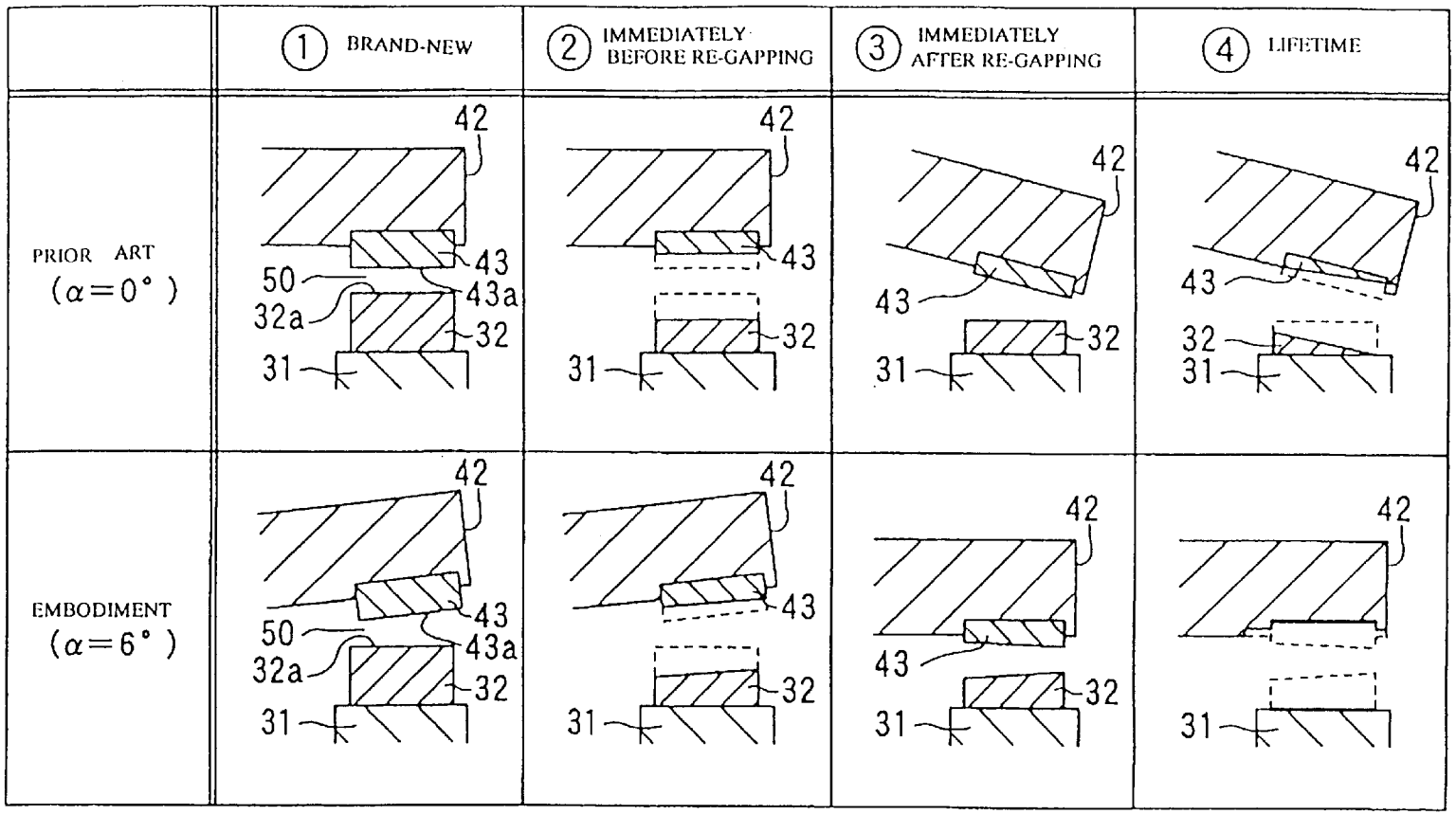
FIG. 3 is a chart sketching the exhausted condition of noble metal tips for comparison between the present invention and a conventional product.

With reference to FIG. 3, functions and effects of the above-described inclined discharging gap arrangement for the noble metal tips will be explained hereinafter. FIG. 3 shows comparison between the present invention and a conventional product, by sketching the exhausted condition of the noble metal tips 32 and 43 at various stages of ① brand-new condition, ② immediately before the re-gapping adjustment, ③ immediately after the re-gapping adjustment, and ④ the end of lifetime.

The illustrations shown in FIG. 3 are based on durability tests conducted by the inventor. The spark plug 100 (inclination angle $\alpha$=6°) of the present invention and a conventional spark plug ($\alpha$=0°) were prepared for the durability tests and evaluated through spark discharging operations in a pressurized chamber (pressure: 0.6 MPa). The initial value of the discharging gap 50 was set to 0.28 mm. When the discharging gap 50 expands by an amount to 0.3 mm, i.e., at the time the discharging gap 50 becomes 0.58 mm, the inventor has performed the re-gapping adjustment to restore the discharging gap 50 to the initial value.

Subsequently, when the discharging gap 50 again expands by 0.3 mm, the inventor has regarded it as the end of lifetime of the tested spark plug.

In the fist stage from the brand-new condition to the timing immediately before the re-gapping adjustment, the electrode tips 32 and 43 of the conventional spark plug have uniformly worn away while maintaining a parallel relationship (i.e., inclined angle $\alpha$=0°) between the opposed surfaces (i.e., discharging surfaces) 32*a* and 43*a*.

On the other hand, due to adoption of the inclined discharging gap arrangement, the electrode tips 32 and 43 of the spark plug 100 have worn away non-uniformly in reverse proportion to the gap between the opposed surfaces 32*a* and 43*a*. More specifically, the electrode tips 32 and 43 have worn away rapidly at the side closer to the stationary end 41 of the grounding electrode 40 where the discharging gap 40 is shortest. As a result, the inclination angle $\alpha$ between the opposed surfaces 32*a* and 43*a* has approached 0° as the exhaustion of the electrode tips 32 and 43 advances.

Then, the inventor has performed the re-gapping adjustment to adjust the discharging gap 50 which expanded due to exhaustion of the tips (i.e., spark discharging portions) 32 and 43. Like the formation of the above-described inclined discharging gap arrangement, the re-gapping adjustment can be done in the following manner.

The worker can bend or deform the grounding electrode 40 with the pin gauge and the jig (e.g., a hammer) so that the free end of the grounding electrode 40 declines or approaches toward the front end 31 of the central electrode 30 about its stationary end 41 until the discharging gap 50 restores to the initial value.

As apparent from FIG. 3, immediately after the re-gapping adjustment, the conventional spark plug has an undesirable discharging gap arrangement according to which the opposed surfaces 32*a* and 43*a* of the electrode tips 32 and 43 are excessively inclined with each other. The discharging gap 50 is shortest at the side closer to the free end 42 of the grounding electrode 40. Namely, the re-gapping adjustment is performed so as to equalize the shortest discharging gap with the initial value (i.e., adequate value).

According to the discharging gap arrangement of the conventional spark plug, after the re-gapping adjustment, exhaustion of the electrode tips 32 and 43 has advanced locally and rapidly at the side closer to the free end 42 of the grounding electrode 40. In other words, the electrode tips 32 and 43 first reach the exhaustion limit (i.e., wear out) at the end closer to the free end 42 of the grounding electrode 40. At this stage, the re-gapping adjustment is no longer applicable. Thus, the lifetime of the spark plug ends although a significant amount of electrode tips still remain.

On the other hand, according to the above-described embodiment of the present invention, after the re-gapping adjustment, the grounding electrode 40 is positioned to be parallel to the central electrode 30 to a certain extent, as shown in FIG. 3. This makes it possible to eliminate the non-uniform exhaustion of the electrode tips 32 and 43 found in the initial stage preceding the re-gapping adjustment. Namely, after the re-gapping adjustment, the positional relationship between the opposed surfaces 32*a* and 43*a* of the electrode tips 32 and 43 comes to a parallel one. Thus, it becomes possible to effectively use the electrode tips 32 and 43 until all of noble metals constituting these tips 32 and 43 are thoroughly worn out. In other words, the present invention improves the wear properties of the spark plug in the final stage succeeding the re-gapping adjustment.

Figure 4:
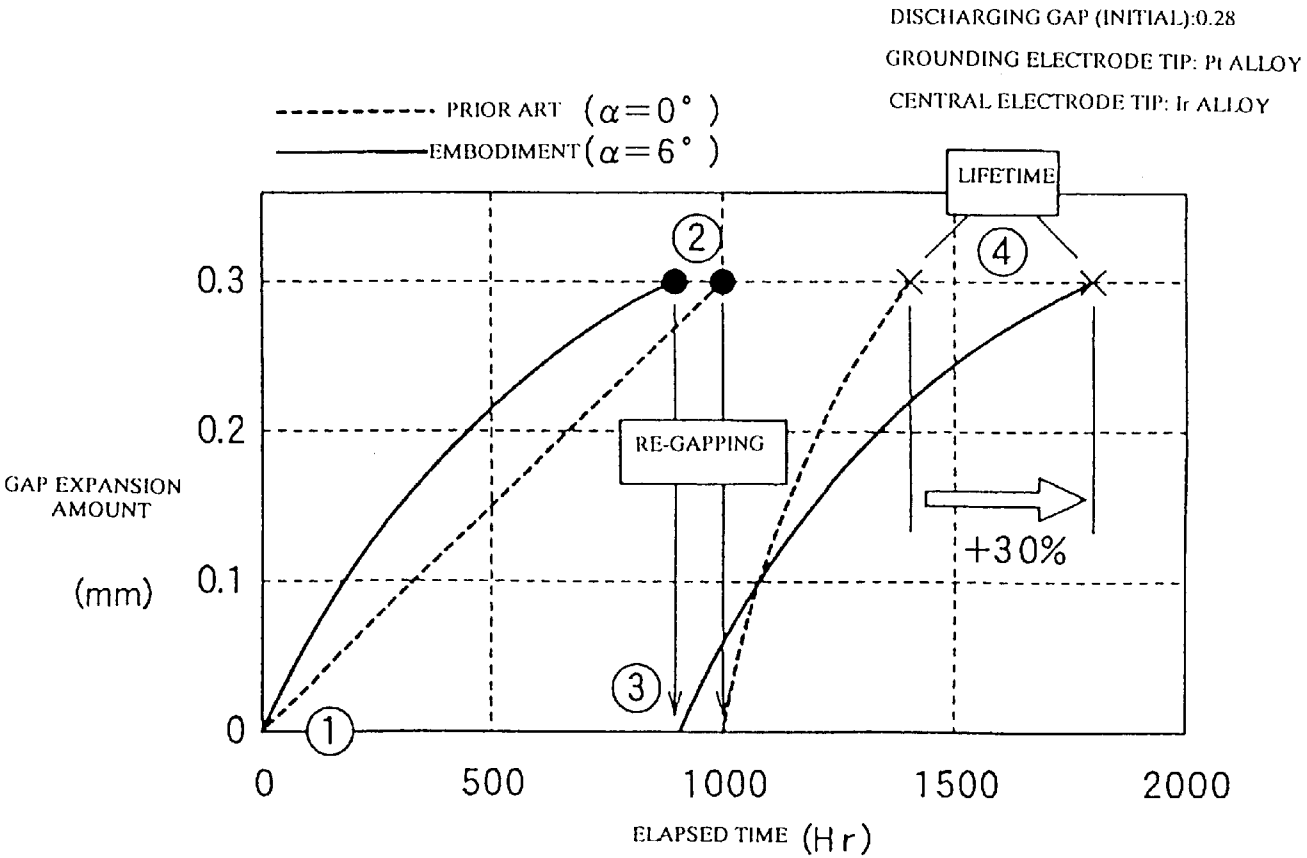
FIG. 4 is a graph showing the transition of a gap expansion amount with respect to the elapsed time in durability tests performed for comparison between the present invention and the prior art.

FIG. 4 is a graph showing the transition of a gap expansion amount (mm) starting from the initial value with respect to the elapsed time (discharging time, Hr) in the durability test. As shown in FIG. 4, according to the above-described embodiment (indicated by a solid line for the inclination angle $\alpha$=6°), the timing of the re-gapping adjustment comes slightly early compared with the prior art (indicated by a dotted line). On the other hand, a duration from the re-gapping adjustment to the end of lifetime is fairly longer than that of the prior art.

As apparent from FIG. 4, according to the conventional spark plug, exhaustion of the electrode tips greatly varies greatly before and after the re-gapping adjustment. On the other hand, according to the present invention, exhaustion of the electrode tips does not vary so greatly before and after the re-gapping adjustment. This demonstrates that the present invention can effective utilize the noble metals constituting the electrode tips 32 and 43. As a result, the present invention makes it possible to extend the lifetime of the spark plug by the degree of approximately 30%. Furthermore, as no difference is found in the exhaustion of the electrode tips before and after the re-gapping adjustment, the duration preceding the re-gapping adjustment can be substantially equalized with the duration succeeding the re-gapping adjustment. Thus, the above-described embodiment makes it possible to perform the maintenance routinely.

Employing the inclined discharging arrangement for the noble metal tips according to the above-described embodiment needs to consider bad influence of the initial stage preceding the re-gapping adjustment which will be shortened compared with the conventional spark plug. To this end, the inclination angle $\alpha$ should be determined carefully.

Figure 5:
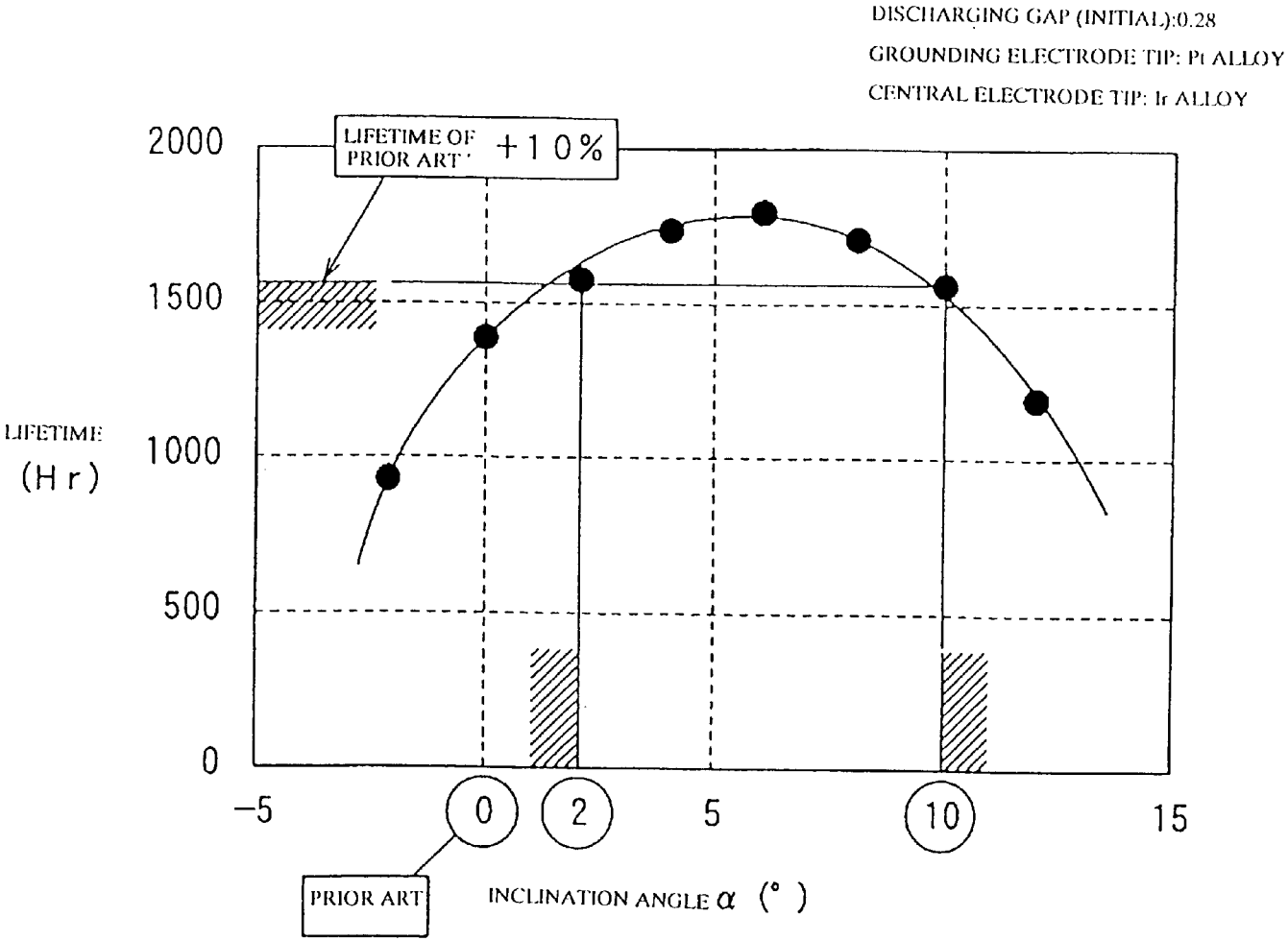
FIG. 5 is a graph showing an effective range of an inclination angle α for the lifetime of the spark plug.

An adequate region of the inclination angle $\alpha$ is dependent on the length of the grounding electrode 40 as well as the longitudinal length of the tips (i.e., spark discharging portions) 32 and 43 extending along the grounding electrode 40. Thus, it is not practically desirable to determine the same adequate region of the inclination angle $\alpha$ commonly applied to all of the spark plugs. FIG. 5 shows the result of tests for the effective inclination angle $\alpha$ based on the metal fitting 10 having the thread ridge 11 whose diameter is set to a general standard value M18.

As can be understood from FIG. 5, an adequate value for the inclination angle $\alpha$ is within a region from 2° to 10°. It was confirmed that setting the inclination angle $\alpha$ to this region extended the lifetime of the spark plug by the degree of more than 10%. If the inclination angle $\alpha$ is smaller than 2°, the effects of the present invention will not be obtained sufficiently. On the other hand, if the inclination angle $\alpha$ is larger than 10°, non-uniformness will increase so greatly in the exhaustion of the electrode tips 32 and 43 during the initial stage preceding the re-gapping adjustment that the effect of the improved wear properties during the final stage succeeding the re-gapping adjustment is substantially canceled. Accordingly, when the spark plug has a general size, it is preferable that the inclination angle $\alpha$ is set within the range from 0° to 10°.

Figure 6:
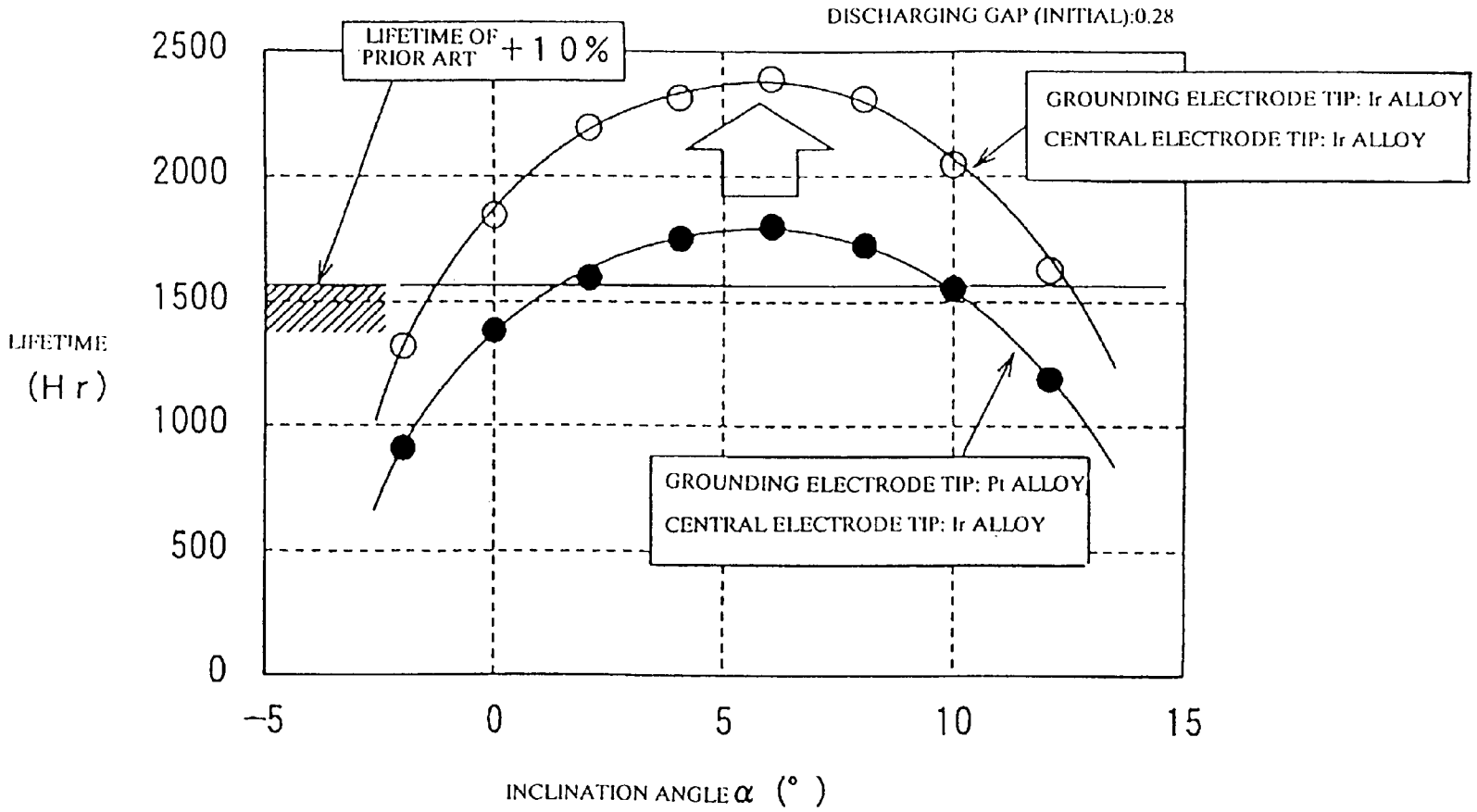
FIG. 6 is a graph showing the effect of using an Ir alloy tip for the lifetime of the spark plug in accordance with the preferred embodiment of the present invention.

FIG. 6 is a graph similar to FIG. 5 but showing the effect of replacing the above-described tips (i.e., grounding electrode tip 43: Pt alloy, and central electrode tip 32: Ir alloy) of the spark plug 100 by electrode tips 32 and 43 both made of an Ir alloy. As understood from FIG. 6, using the Ir alloy tips 32 and 43 makes it possible to extend the lifetime of the spark plug greatly. Thus, it is preferable that the electrode tips 32 and 43 are made of an Ir alloy.

Figure 7:
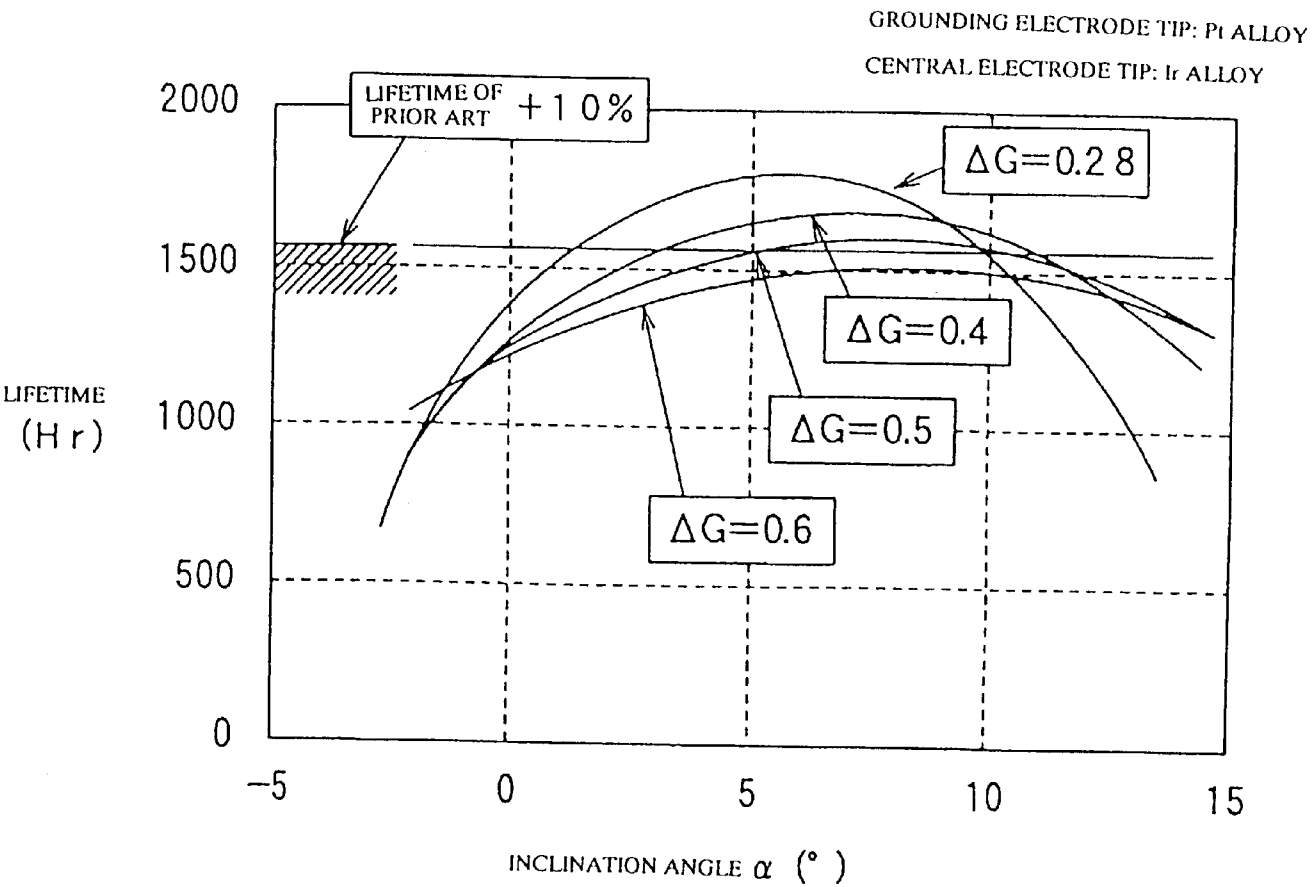
FIG. 7 is a graph showing an effective range of a discharging gap ΔG for the lifetime of the spark plug in accordance with the preferred embodiment of the present invention.

FIG. 7 shows the test result of effective discharging gap $\Delta G$. As understood from FIG. 7, an adequate discharging gap $\Delta G$ is within a range from 0.2 mm to 0.5 mm. It was recognized that the lifetime can be extended by selecting the discharging gap $\Delta G$ of 0.2 mm to 0.5 mm compared with the conventional spark plug.

The discharging gap ΔG shorter than 0.2 mm will not bring satisfactory ignitability which is one of basic performances required for the spark plug. On the other hand, the discharging gap larger than 0.5 mm will not sufficiently assure the effect of the inclined discharging gap arrangement brought by the present invention. The lifetime of the spark plug will not be extended so much. Accordingly, when the above-described embodiment is put into practice, it is preferable that the discharging gap (initial value) is within the range from 0.2 mm to 0.5 mm.

As apparent from the foregoing, employment of the inclined discharging gap arrangement for the noble metal tips makes it possible to locate the grounding electrode 40 in parallel with the front end 31 of the central electrode 30 when the re-gapping adjustment is performed. Accordingly, after the re-gapping adjustment, the remaining noble metals of the electrode tips (spark discharging portions) 32 and 43 are entirely worn out. In other words, almost all of the remaining noble metal tips can be effectively utilized for the final stage of the spark exhaustion. Thus, the above-described embodiment of the present invention assures improved wear properties for the spark plug after the re-gapping adjustment and accordingly extends the lifetime of the spark plug.

Furthermore, the above-described embodiment of the present invention provides an adjusting method for the spark plug. The central electrode tip 32 and the grounding electrode tip 43 are disposed in such a manner that the discharging gap 50 has the first gap G1 at one side closer to the stationary end 41 of the grounding electrode 40 and the second gap G2 at the opposite side closer to the free end 42 of the grounding electrode 40, with the first gap G1 being shorter than the second gap G2 so as to set the inclined angle α. The discharging gap 50 is adjusted to an adequate value when the discharging gap 50 is increased due to exhaustion of the electrode tips 32 and 43, by bringing the grounding electrode tip 43 to a position closer to the central electrode tip 32 so as to decrease the inclination angle α.

More specifically, the grounding electrode tip 43 is disposed to have the inclination angle α with respect to the central electrode tip 32. The discharging gap 50 is wide at the side closer to the free end 42 of the grounding electrode 40. When the discharging gap 50 has expanded due to exhaustion of the electrode tips 32 and 43, the grounding electrode tip 43 is declined or pushed toward the central electrode tip 32 so as to decrease the inclination angle α. Thus, the above-described embodiment provides the adjusting method for the spark plug capable of adjusting the discharging gap 50 to the adequate value. Therefore, the adjusting method of the above-described embodiment assures improved wear properties for the spark plug after the re-gapping adjustment and accordingly extends the lifetime of the spark plug.

Figure 8A:
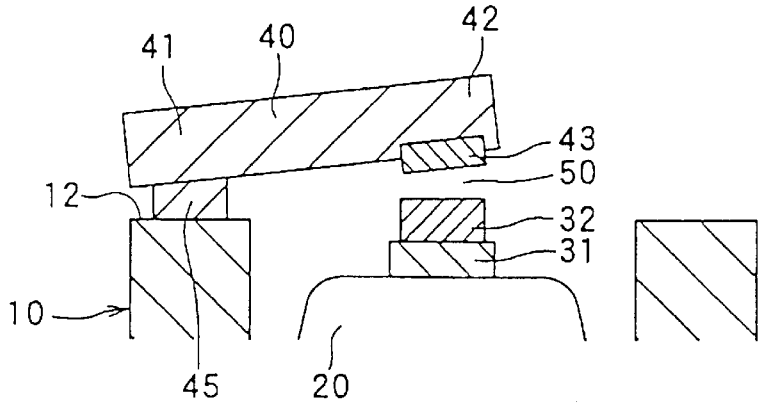
FIG. 8A is a cross-sectional view showing one example of a first modification of the spark plug in accordance with the preferred embodiment of the present invention.

FIGS. 8A through 10B show modified embodiments of the present invention. Employing the inclined discharging gap arrangement for the noble metal tips of the present invention to these modifications bring the same effects as those of the above-described embodiment. FIGS. 8A and 8B cooperatively show a first modification characterized in that the grounding electrode 40 is substantially a straight rod.

Figure 8B:
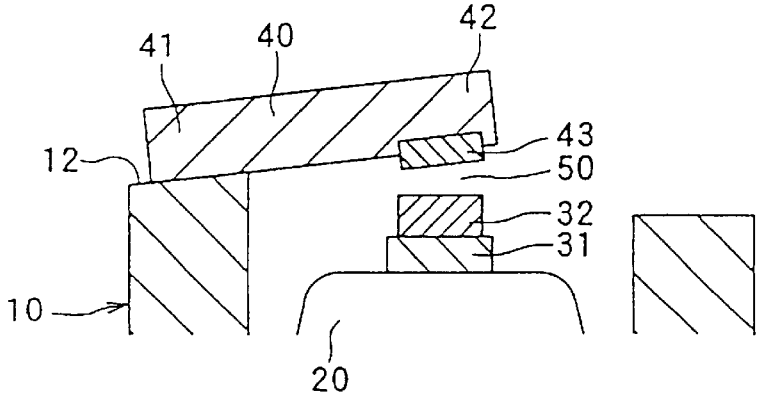
FIG. 8B is a cross-sectional view showing another example of the first modification of the spark plug in accordance with the preferred embodiment of the present invention.

According to the first modification, as shown in FIG. 8A, the stationary end 41 of the grounding electrode 40 is welded to the one axial end 12 of the metal fitting 10 via an intermediate member 45 made of a Ni-based alloy. Alternatively, as shown in FIG. 8B, the stationary end 41 of the grounding electrode 40 can be directly welded to the axial end 12 of the metal fitting 10 when the front end 31 of the central electrode 30 is located at a retracted position with respect to the axial end 12 of the metal fitting 10. According to the first modification, the worker can perform the re-gapping adjustment so as to decline or push the free end 42 toward the central electrode 30 about the stationary end 41.

Figure 9:
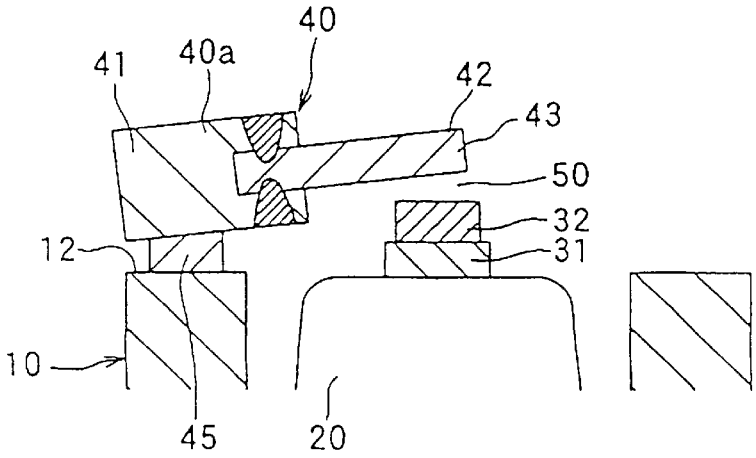
FIG. 9 is a cross-sectional view showing a second modification of the of the spark plug in accordance with the preferred embodiment of the present invention.

FIG. 9 shows a second modification which is characterized in that the grounding electrode 40 comprises a mounting block (Ni-based alloy or the like) 40*a* welded to the axial end 12 of the metal fitting 10 via the intermediate 45 and a rodlike grounding electrode tip (Ir or the like) 43 inserted into the mounting block 40*a* and securely welded together. According to the second modification, the worker can perform the re-gapping adjustment by deforming the mounting block 40*a* or the rodlike tip 43 toward the central electrode 30.

Figure 10A:
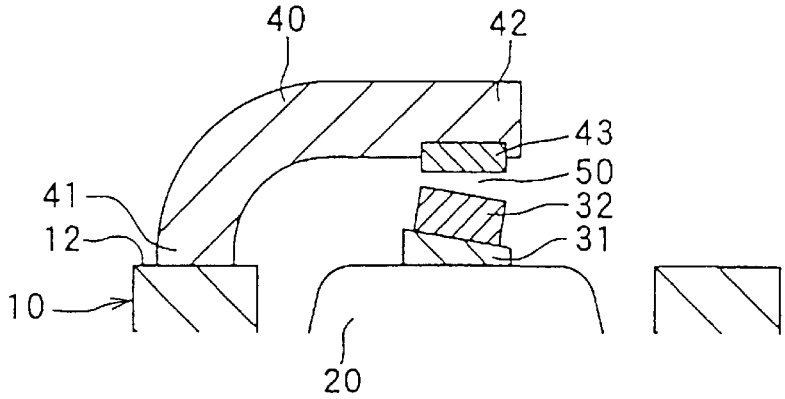
FIG. 10A is a cross-sectional view showing a third modification of the of the spark plug in accordance with the preferred embodiment of the present invention.

FIG. 10A shows a third modification which inclines the top surface of the front end 31 of the central electrode 30 to realize the inclined discharging gap arrangement of the present invention. For example, the worker can cut the upper end of the front end 31 obliquely and then weld the central electrode tip 32 on the oblique top surface of the front end 31.

Figure 10B:
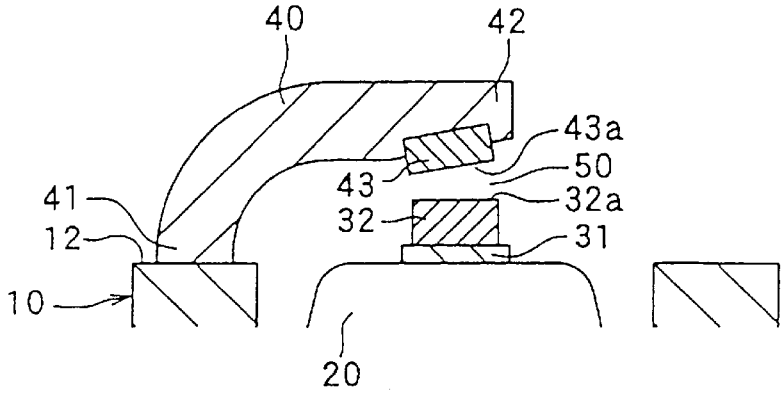
FIG. 10B is a cross-sectional view showing a fourth modification of the of the spark plug in accordance with the preferred embodiment of the present invention.

Furthermore, FIG. 10B shows a fourth modification which inclines the free end 42 of the grounding electrode 40 to realize the inclined discharging gap arrangement of the present invention. It is needless to say that the above-described embodiments can be flexibly combined.

According to the above-described embodiments, the discharging gap 50 is provided between the opposed surfaces (i.e., discharging surfaces) 32*a* and 43*a* of the electrode tips 32 and 43. Therefore, the discharging gap 50 linearly increases from the first gap G1 to the second gap G2 along the opposed surfaces 32*a* and 43*a* so as to realize the inclined discharging gap arrangement with the first gap G1 narrower than the second gap G2. However, the embodiments of the present invention can be modified as shown in FIGS. 11A and 11B.

Figure 11A:
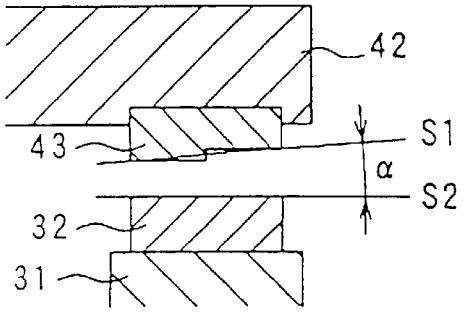
FIG. 11A is a cross-sectional view showing the configuration of the noble metal tips in accordance with another embodiment of the present invention.
Figure 11B:
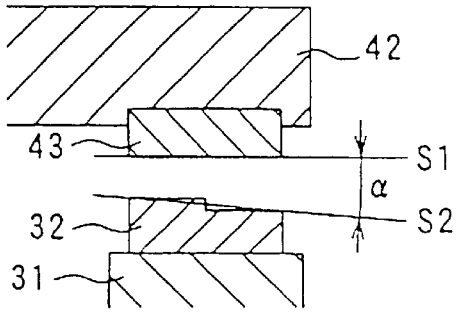
FIG. 11B is a cross-sectional views showing the configuration of the noble metal tips in accordance with another embodiment of the present invention.

According to this embodiment, the opposed surface 43*a* of the grounding electrode tip 43 is stepped (refer to FIG. 11A) or the opposed surface 32*a* of the central electrode tip 32 is stepped (refer to FIG. 11B). Thus, the discharging gap 50 increases stepwise or non-linearly from the first gap G1 to the second gap G2.

In this case, the straight line S1 connects both edges of the grounding electrode tip 43 while the straight line S2 connects the both edges of the central electrode tip 32 as shown in FIGS. 11A and 11B.

Furthermore, above-described embodiments are based on a single central electrode tip 32 and a single grounding electrode tip 43. However, the present invention does not limit the total number of the electrode tips 32 and 43. Furthermore, the present invention allows the electrode tips 32 and 43 to be configured into a rectangular rod.

Figure 12A:
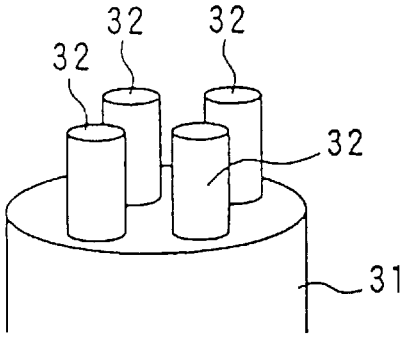
FIG. 12A is a perspective view showing the configuration of the noble metal tips in accordance with another embodiment of the present invention.

FIG. 12A shows an embodiment characterized by four noble metal tips 32 are provided on the central electrode 30. The inclined discharging gap arrangement can be realized by adjusting the length or height of each tip 32.

Figure 12B:
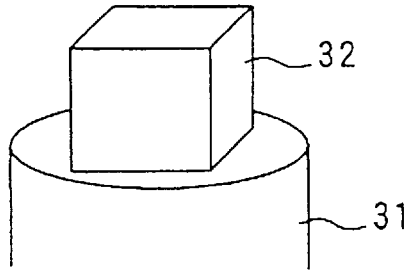
FIG. 12B is a perspective view showing the configuration of the noble metal tips in accordance with another embodiment of the present invention.

FIG. 12B shows another embodiment characterized by a square rodlike noble metal tip 32 provided on the central electrode 30.

The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A spark plug used for cogeneration purpose and requiring a re-gapping adjustment after a period of use, comprising:

a central electrode;

an insulator provided around said central electrode;

a metal fitting provided around said insulator;

a grounding electrode having one end connected to said metal fitting and the other end located in opposed relationship with said central electrode; and noble metal tips attached on opposed surfaces of said central electrode and said grounding electrode, wherein a discharging gap is formed between the noble metal tip of said central electrode and the noble metal tip of said grounding electrode, said noble metal tips of the electrodes are disposed in such a manner that said discharging gap has a first gap at one side closer to said one end of said grounding electrode and a second gap at an opposite side closer to said other end of said grounding electrode, with said first gap being shorter than said second gap, a first straight line connecting both edges of said noble metal tip attached on said grounding electrode inclines by an angle $\alpha$ of 2° to 10° with respect to a second straight line connecting both edges of said noble metal tip attached on said central electrode, where said both edges of said noble metal tip of said grounding electrode and both edges of said noble metal tip of said central electrode cooperatively define said first gap and said second gap, and a minimum distance of said discharging gap is within a range from 0.2 mm to 0.5 mm.

2. The spark plug used for cogeneration purpose in accordance with claim 1, wherein each of said noble metal tip of said grounding electrode and said noble metal tip of said central electrode is made of an iridium alloy containing not less than 50 wt % Ir.

3. A spark plug as in claim 1, wherein the noble metal tip of said central electrode is a disk like member, the noble metal tip of said grounding electrode is a disk like member, and the inclination angle $\alpha$ is 6°.

4. A spark plug as in claim 3, wherein said discharge gap between the noble metal tip of said central electrode and the noble metal tip of said grounding electrode is about 0.28 mm.

5. A spark plug as in claim 1, wherein the noble metal tip of said central electrode is generally square in cross-section.

6. A spark plug as in claim 1, wherein a plurality of noble metal tips are provided on the central electrode and wherein the inclined discharging gap is provided by adjusting a length or a height of each said tip on the central electrode.

7. A spark plug as in claim 1, wherein the discharging gap increases non-linearly from the first gap to the second gap.

8. A spark plug as in claim 1, wherein a gap facing surface of the noble metal tip of the central electrode is inclined at an angle of greater than 0° with respect to said opposed surface of the central electrode.

9. A spark plug as in claim 8, wherein said gap facing surface is inclined by said angle $\alpha$ with respect to said opposed surface of the central electrode.

10. A spark plug as in claim 1, wherein a gap facing surface of the noble metal tip of the grounding electrode is disposed at an angle of greater than 0° with respect to said opposed surface of the grounding electrode.

11. A spark plug as in claim 10, wherein the gap facing surface is inclined by said angle $\alpha$ with respect to said opposed surface of the grounding electrode.

12. An adjusting method for a spark plug used for cogeneration purpose, said spark plug comprising a metal fitting for mounting a central electrode via an insulator provided around said central electrode, a grounding electrode having one end connected to said metal fitting and the other end located in opposed relationship with said central electrode, and noble metal tips attached on opposed surfaces of said central electrode and said grounding electrode so that a discharging gap is formed between the noble metal tip of said central electrode and the noble metal tip of said grounding electrode, wherein said discharging gap is adjusted when said noble metal tips are exhausted to a certain extent, said adjusting method comprising the steps of:

disposing said noble metal tips in such a manner that said discharging gap has a first gap at one side closer to said one end of said grounding electrode and a second gap at an opposite side closer to said other end of said grounding electrode, with said first gap being shorter than said second gap, so that a first straight line connecting both edges of said noble metal tip attached on said grounding electrode inclines by an angle $\alpha$ with respect to a second straight line connecting both edges of said noble metal tip attached on said central electrode, where said both edges of said noble metal tip of said grounding electrode and said both edges of said noble metal tip of said central electrode cooperatively define said first gap and said second gap, wherein said angle $\alpha$ is within a range from 2° to 10°, and a minimum distance of said discharging gap is within a range from 0.2 mm to 0.5 mm; and adjusting said discharging gap to an adequate value, as a re-gapping adjustment, when said discharging gap is increased due to exhaustion of said noble metal tips of both electrodes, by bringing said noble metal tip attached on said grounding electrode to a position closer to said noble metal tip attached on said central electrode so as to decrease said angle $\alpha$.

13. The adjusting method for a spark plug used for cogeneration purpose in accordance with claim 12, wherein each of said noble metal tip of said grounding electrode and said noble metal tip of said central electrode is made of an Ir alloy containing not less than 50 wt % Ir.

* * * * *